US007299609B1

(12) United States Patent
Epstein

(10) Patent No.: US 7,299,609 B1
(45) Date of Patent: Nov. 27, 2007

(54) PISTON-CYLINDER ACTUATOR AND MOUNTING SUPPORT FOR THE LOWER TOOL OF AN INDEXING PACKAGING MACHINE

(76) Inventor: Moshe Epstein, 2530 Queensway, Northbrook, IL (US) 60062

( * ) Notice: Subject to any disclaimer, the term of this patent is extended or adjusted under 35 U.S.C. 154(b) by 0 days.

(21) Appl. No.: 11/425,466

(22) Filed: Jun. 21, 2006

(51) Int. Cl.
*B65B 47/04* (2006.01)
*B65B 43/08* (2006.01)
*B29C 51/38* (2006.01)

(52) U.S. Cl. ..... 53/561; 53/456; 264/299

(58) Field of Classification Search ..... 53/453, 53/456, 559, 561; 493/143, 158; 264/239, 264/299, 320, 329; 72/348
See application file for complete search history.

(56) References Cited

U.S. PATENT DOCUMENTS 2,959,900 A * 11/1960 Wollett ..... 53/432
3,312,098 A * 4/1967 Hendrickson ..... 72/349
3,657,855 A * 4/1972 Swezey ..... 53/397
3,786,667 A * 1/1974 Garnett, Jr. ..... 72/348
3,788,032 A * 1/1974 Heffernan et al. ..... 53/141
3,808,772 A * 5/1974 Turtschan ..... 53/141
3,920,371 A * 11/1975 Faller ..... 425/388
4,048,781 A * 9/1977 Johansen ..... 53/453
4,162,599 A * 7/1979 Kyle ..... 53/77
4,228,121 A * 10/1980 Meadors ..... 264/291
4,366,663 A * 1/1983 Grebe ..... 53/559
4,506,495 A * 3/1985 Romagnoli ..... 53/559
4,685,274 A * 8/1987 Garwood ..... 53/433
4,730,761 A * 3/1988 Spano ..... 225/2
4,862,676 A * 9/1989 Mancini ..... 53/453
4,909,722 A * 3/1990 Wakayama et al. ..... 425/384
4,951,444 A * 8/1990 Epstein et al. ..... 53/77
4,951,537 A * 8/1990 Bennett ..... 83/76.6
5,096,108 A * 3/1992 Kuze ..... 225/97
5,170,611 A * 12/1992 Buchko et al. ..... 53/453
5,172,854 A * 12/1992 Epstein et al. ..... 229/123.3
5,242,641 A * 9/1993 Horner et al. ..... 264/104
5,271,207 A * 12/1993 Epstein et al. ..... 53/432
5,517,805 A * 5/1996 Epstein ..... 53/453
5,623,810 A * 4/1997 Dey et al. ..... 53/425
5,662,849 A * 9/1997 Bogue et al. ..... 264/112
5,876,765 A * 3/1999 Hinterlechner ..... 425/116
6,202,388 B1 * 3/2001 Sanfilippo et al. ..... 53/432
6,513,306 B1 * 2/2003 Milano ..... 53/453
6,748,726 B2 * 6/2004 Rossi et al. ..... 53/510
6,941,729 B2 * 9/2005 Dal Pozzo ..... 53/453
7,047,858 B2 * 5/2006 Rohrer et al. ..... 83/582

* cited by examiner

*Primary Examiner*—Rinaldi I. Rada
*Assistant Examiner*—Paul Durand

(57) ABSTRACT

A piston-cylinder arrangement is provided for mounting and actuating the lower tool of an indexing packaging machine, which has an annular piston head that has a ratio of outer diameter to inner diameter that is less than two, and which drives a relatively oversized hollow piston rod having a protruding mounting portion that projects upwardly and outwardly from the main cylinder, to the upper end of which is mounted an upper mounting plate connected to the lower tool of a station of the packaging machine. The oversized piston rod or shaft ensures stable and tilt-free mounting of the lower tool that ensures the parallelism thereof with the upper stationary tool, while providing more than the necessary force for activating the lower tool.

13 Claims, 5 Drawing Sheets

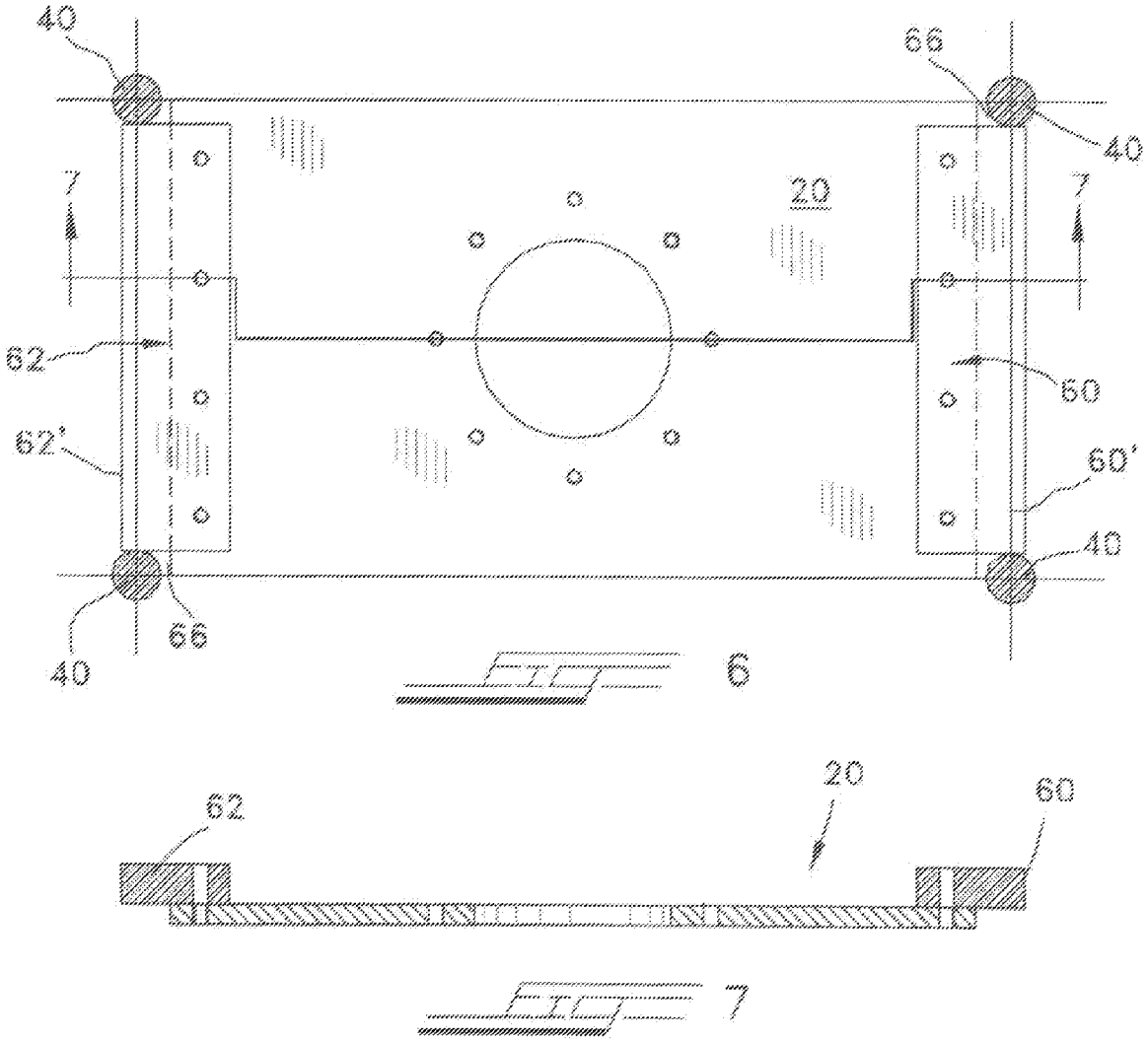
40
66
7
60
60'
40
20
6
7
40
62
62'
7
66
40
60
20
62

PISTON-CYLINDER ACTUATOR AND MOUNTING SUPPORT FOR THE LOWER TOOL OF AN INDEXING PACKAGING MACHINE

BACKGROUND OF THE INVENTION

The present invention is directed to a mounting support and actuator for a lower tool of an indexing packaging machine, in which web material is indexed using an indexing advancing mechanism for situating the packages being formed at a forming station and a sealing or sealing/vacuum forming station. At each station, a lower tool is raised toward an upper, stationary tool for performing the requisite tasks at the respective station. Hithertofore, the lower tool has been raised by a complicated linkage mechanism, consisting of cams, links, connecting members, chains, and activators, that maintains and ensures the parallelism of the lower tool with the upper tool, which parallelism is critical to the proper functioning of the apparatus and formation of acceptable packages. Examples of these prior-art structures are shown, for example, in U.S. Pat. Nos. 5,170,611 and 5,517,805. However, these prior-art, lower-tool activating mechanisms, owing to their weight and complexity, require large and heavy side support plates on the packaging machine in order to support and bear the heavy load and forces thereof, with such forces sometimes exceeding 10,000 pounds during the raising of the lower tool. Moreover, owing to the complex and sensitive nature of these prior-art lower-tool activating and support mechanisms, downtime of the packaging apparatus is not uncommon in order to fix or fine tune a problem thereof.

Because of the above-mentioned drawbacks, it would be highly advantageous to provide a support and actuator for the lower tools of a packaging machine that require less load-bearing for the packaging machine frame, and which is less complicated and less prone to downtime.

SUMMARY OF THE INVENTION

It is, therefore, the primary objective of the present invention to provide a new mounting and actuating structure for the lower tool of each station of an indexing packaging machine that is less complicated and requires considerably less frame load-bearing.

It is the primary objective of the present invention to provide such a mounting and actuating structure for the lower tool of an indexing packaging machine that consists of a piston-cylinder arrangement mounted in a suspended manner.

Toward these and other ends, the present invention consists of a piston-cylinder arrangement having donut-shaped or annular piston head that has a ratio of outer diameter to inner diameter that is less than two, and which drives a relatively oversized hollow piston rod or shaft having a protruding mounting portion that projects upwardly and outwardly from the main cylinder, to the upper end of which is mounted an upper mounting plate connected to the lower tool of a station of a packaging machine. The oversized piston rod or shaft ensures stable and tilt-free mounting of the lower tool that ensures the parallelism thereof with the upper stationary tool, while providing more than the necessary force for activating the lower tool. Since the overall actuating and mounting structure of the invention is considerably lighter than that of the prior art, and since the side plates of the packaging machine frame are no longer are required to bear an extremely heavy load of the lower-tool mounting and actuating structure, the side plates may be made considerably thinner as compared to the prior art since they need only support the weight of the station, and not the forces associated with, and generated by, the operation of the machine during tool activation.

BRIEF DESCRIPTION OF THE DRAWINGS

The invention will be more readily understood with reference to the accompanying drawings, wherein:

FIG. 6 is a top view of the mounting plate for mounting the lower tool to the piston rod of the piston-cylinder mounting and actuator of FIG. 1;

FIG. 7 is a cross-sectional view thereof, and

DETAILED DESCRIPTION OF THE INVENTION

Figure 1:
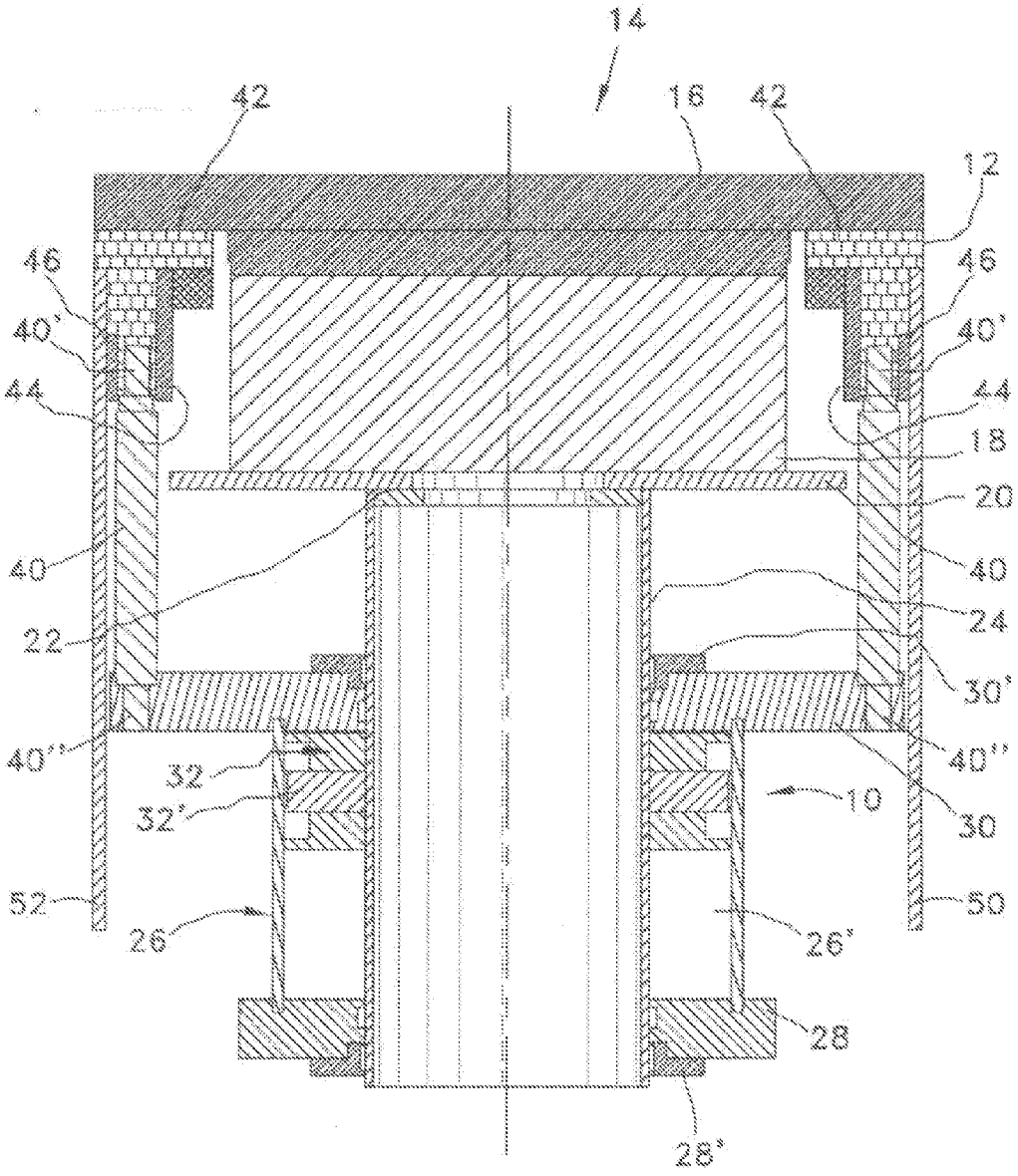
FIG. 1 is an elevational cross-sectional view of the piston-cylinder mounting and actuator for a lower tool of an indexing packaging machine according to the present invention.
Figure 2:
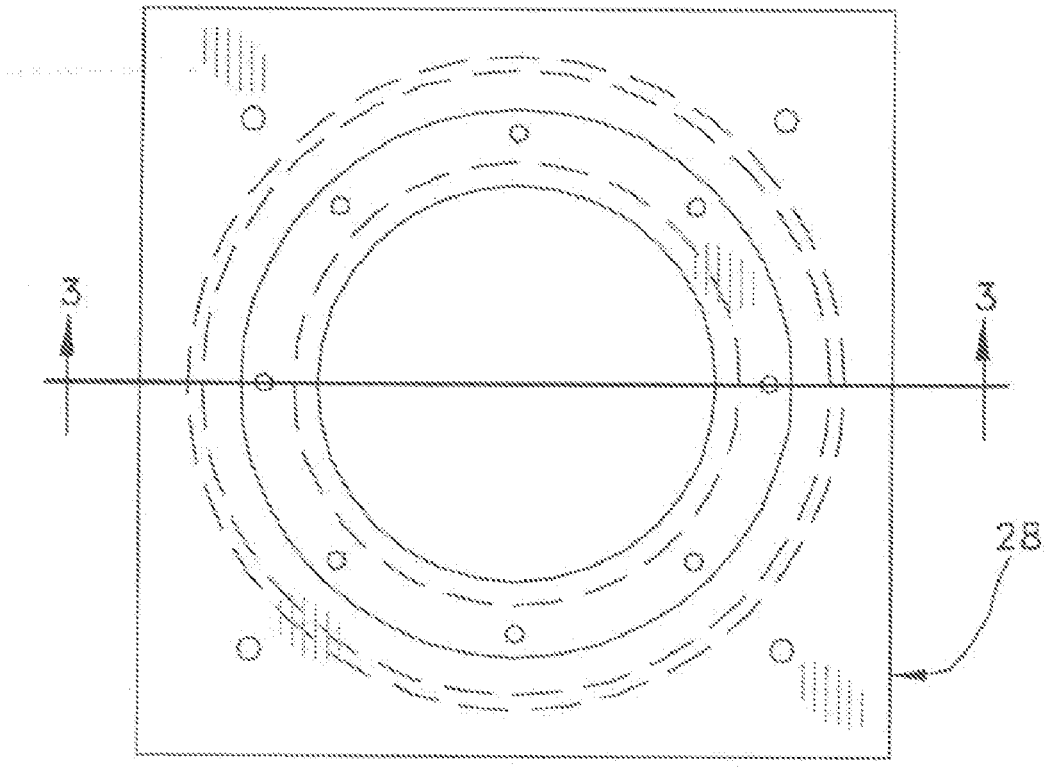
FIG. 2 is a top view of the lower cylindrical plate of the piston-cylinder mounting and actuator of FIG. 1.
Figure 3:
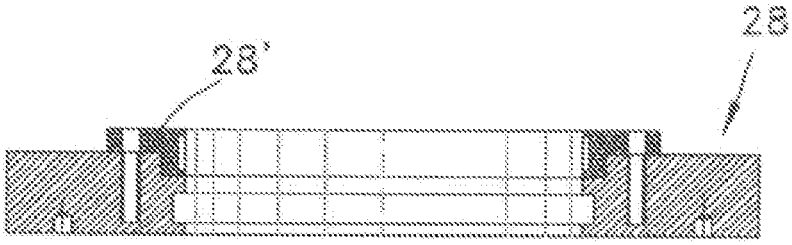
FIG. 3 is a cross-sectional view thereof.

Referring now to the drawings in greater detail, and to FIG. 1 for now, the compressed-air, piston-cylinder mounting support and actuator of the invention is indicated generally by reference numeral 10 and is shown in its actuated state where a lower tool is brought into operative engagement with an upper tool. The piston-cylinder mounting support and actuator 10 is mounted to the frame 12 of an indexing packaging machine 14 which includes an upper, stationary tool 16 and a lower, vertically-reciprocal tool 18. The lower, vertically-reciprocal tool 18 is mounted to an upper mounting plate 20, best seen in FIGS. 6 and 7, affixed to the upper end-surface 22 of vertically-reciprocal, relatively-oversized piston rod 24 of the piston-cylinder mounting support and actuator 10. The piston-cylinder mounting support and actuator 10 consists of a stationary cylinder 26 having a lower plate 28 with seal 28', best seen in FIGS. 2 and 3, and upper plate 30 with seal 30', best seen in FIGS. 4 and 5, defining therebetween a piston compression chamber 26' for a reciprocal, annular, or donut-shaped, piston 32 having a piston seal 32', that drives the relatively-oversized hollow piston rod or shaft 24, to the upper end of which is mounted the lower-tool mounting plate 20 for the lower tool 18 of a station of the multi-station packaging machine 14. In accordance with the present invention, the annular piston head 32 has a ratio of outer diameter to inner diameter that is less than two, in contrast to conventional piston-cylinder arrangements where this ratio is considerably larger. Thus, the piston rod of the piston-cylinder arrangement of the present invention is considerably, relatively larger relative to the size of the piston head proper in comparison to prior art piston-cylinder arrangements, in order to support the lower tool without tilting and skewing even under the 6-10K pounds load with a pressure source of between 80-120 psi used to press the lower tool against the upper tool when actuated. The oversized piston rod or shaft ensures stable and tilt-free mounting of the lower tool 18 and ensures the parallelism thereof with the upper stationary tool 16, while providing more than the necessary force for activating the lower tool. Also, the ratio of the outer diameter of the annular piston to the outer diameter of the piston rod is also less than two.

Figure 4:
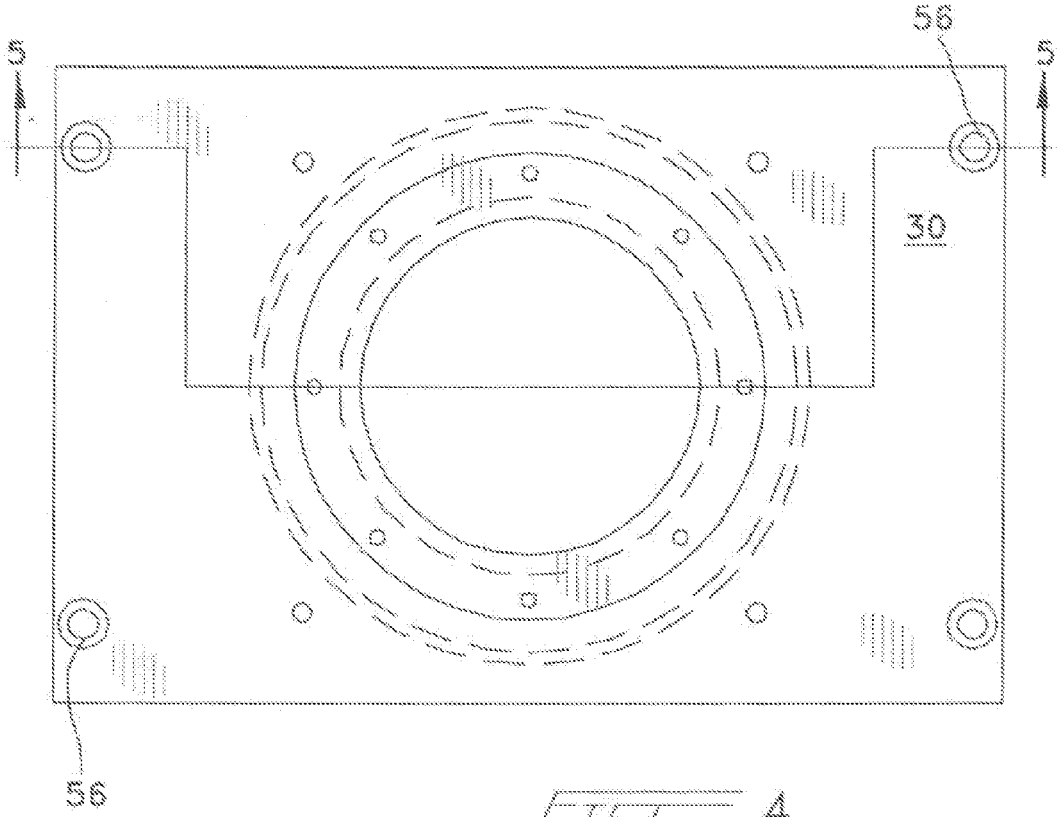
FIG. 4 is a top view of the upper cylindrical plate of the piston-cylinder mounting and actuator of FIG. 1.
Figure 5:
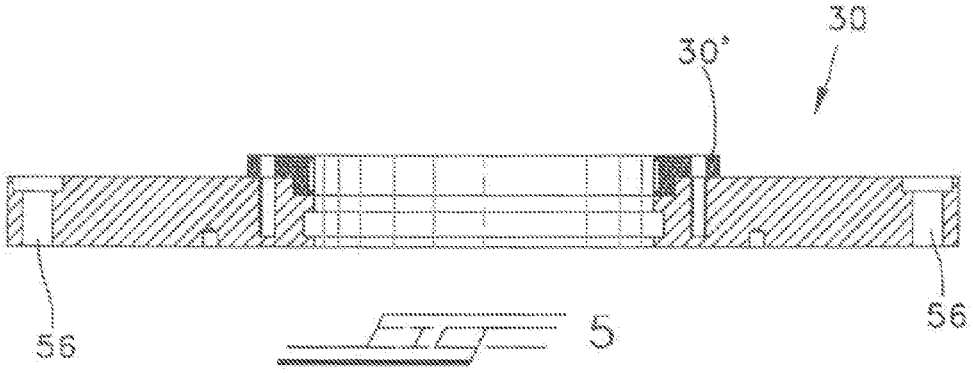
FIG. 5 is a cross-sectional view thereof.
Figure 8:
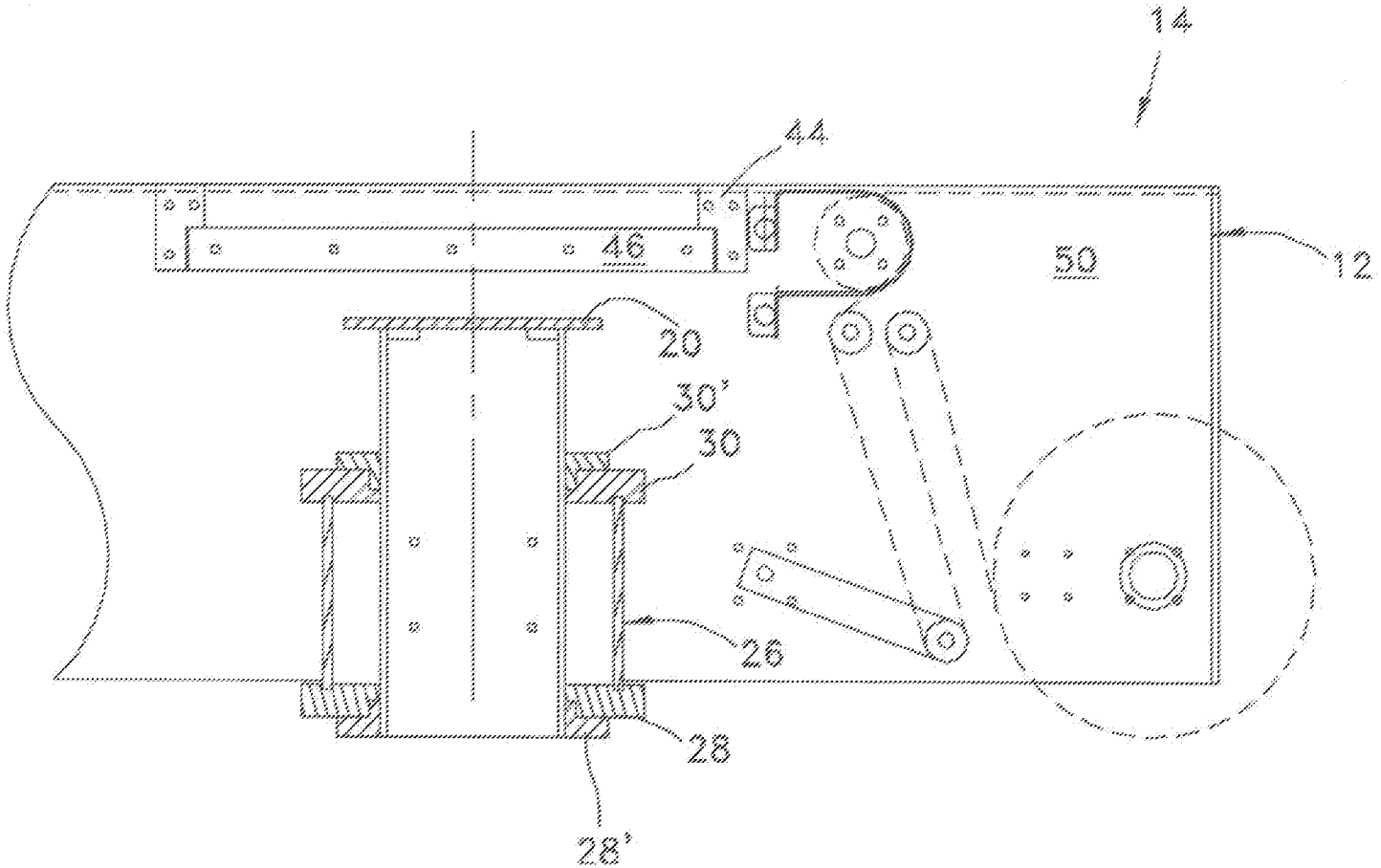
FIG. 8 is a broken-away, elevational view of the piston-cylinder mounting and actuator of FIG. 1 shown mounted in the frame of an indexing packaging machine between the side plates that mount an upper tool, shown without the upper and lower tools for purposes of clarity.

The piston-cylinder mounting support and actuator 10 is mounted in a suspended manner to the frame 12 via four, corner mounting rods 40, as best seen in FIGS. 1 and 4-8. Each corner rod 40 has an upper end 40' mounted in a carrier block portion 42, which carrier block, in the conventional manner, supports and adjustably positions the upper tool in the longitudinal direction for accommodating different molds used in the multi-packaging machine 14. The carrier block 42 is conventionally mounted for sliding movement in carrying bars 44, 46 secured to the side plates 50, 52 of the frame 12, as is well-known and conventional, so that both the upper and lower tools 16, 18 are moved in unison to adjust to the mold positioned in the machine. Lower ends 40" of the mounting rods 40 are located in corner openings 56 in the upper plate 30, and are affixed therein, preferably by bolts, as best seen in FIGS. 1, 4 and 5.

The mounting rods 40 also stabilize the lower tool 18 by preventing rotation of the upper plate 20, as best seen in FIGS. 6 and 7. This is accomplished as follows. The upper plate 20 is provided with a pair of end-plates 60, 62, each having a projecting portion 60', 62' projecting from an end of the upper plate 20. Each end-plate 60, 62 has a length less than the width of the upper plate 20, so as so form thereby a right-angle shaped opening or passageway 66 at each corner, through which passes a respective section of a rod 40. The contact of the edge-surfaces of the end-plates 60, 62 against the juxtapositioned sections of the rods 40 prevent the plate 20, and, therefore, the lower tool 18 attached to the upper plate 20, from rotating, to thus ensure a stabilized lower tool. In addition, as explained above, the oversized piston rod ensures stable and tilt-free mounting of the lower tool that ensures the parallelism thereof with the upper stationary tool, while providing more than the necessary force for activating the lower tool. Since the overall actuating and mounting structure of the invention is considerably lighter than that of the prior art, and since the side plates of the packaging machine frame no longer are required to bear the heavy load of the prior-art tool-lifting mounting and actuating structure, these side plates may be made considerably thinner as compared to the prior art.

In a preferred embodiment, the diameter of the piston rod or shaft 24 is preferably between seven and eleven inches. In one preferred embodiment, the outer diameter of the piston rod 24 is 8⅝ in., while the outer diameter of the annular piston 32 is approximately 13¼ in. with the inner diameter of the annular piston being 8⅝ in. Preferably, the range for the outer diameter is between 13⅛ in. and 13⅜ in., while the range for the inner diameter is between 8½ in. and 8¾ in. Also, the range for the outer diameter of the piston rod is between 8½ in. and 8¾ in.

While a specific embodiment of the invention has been shown and described, it is to be understood that numerous changes and modifications may be made therein without departing from the scope and spirit of the invention.

What is claimed is:

1. In a packaging machine comprising a main frame, at least one work station having a vertically-movable lower tool and an upper tool for forming a package, means for mounting said lower tool, and an actuator for actuating said lower tool for vertical movement toward and away from said upper tool, the improvement comprising:

said actuator for actuating said lower tool for vertical movement comprising a piston-cylinder actuator;

said piston-cylinder actuator comprising a main cylinder defining a compression chamber, an annular piston mounted for reciprocal movement in said compression chamber, a hollow piston shaft for movement with said piston and having an upper end projecting from the upper end of said main cylinder, and a lower-tool mount affixed to said projecting upper end of said piston shaft fixedly connected to said lower tool;

said annular piston defining an outer diameter and an inner diameter, the ratio of said outer diameter to said inner diameter being less than two.

2. The improvement according to claim 1, wherein said means for mounting said lower tool comprises a plurality of mounting rods, each said mounting rod having an upper end portion connected to an upper portion of said main frame and a lower end portion; said main cylinder of said piston-cylinder actuator comprising an upper plate; each said lower end portion of each said mounting rod being connected to a respective portion of said upper plate.

3. The improvement according to claim 2, wherein each said lower end portion of a respective said mounting rod is connected to a respective corner portion of said upper plate; said upper ends of said mounting rods being connected to a carrier block for said upper tool whereby said upper tool and said lower tool may be adjusted along the length of said main frame in unison for adjustment to various molds used in said packaging machine.

4. The improvement according to claim 3, wherein said lower-tool mount comprises a mounting plate consisting of a main plate portion and a pair of rotation-prevention means projecting from the ends of said main plate portion; said mounting rods passing in close proximity to said ends of said main plate portion; each said rotation-prevention means projecting into the space formed between a pair of mounting rods located at a respective end of said main plate portion for preventing rotation of said mounting plate and, therefore, said lower tool mounted thereto.

5. The improvement according to claim 3, wherein said lower-tool mount comprises a mounting plate consisting of a main plate portion and rotation-prevention means projecting from the ends of said main plate portion cooperating with said mounting rods for preventing rotation of said mounting plate and, therefore, said lower tool mounted thereto.

6. The improvement according to claim 1, comprising a plurality of work stations each having a lower tool, each said work station having a said piston-cylinder actuator for actuating the lower tool thereof.

7. The improvement according to claim 1, wherein said annular piston has an outer diameter in the range of approximately between 13⅛ in. and 13⅜ in. and an inner diameter in the range of approximately between 8½ in. and 8¾ in.

8. The improvement according to claim 1, wherein said piston rod has a diameter of between approximately 8½ in. and 8¾ in.

9. An actuator for the lower tool of a packaging machine having a vertically-movable tool and an upper tool for forming a package, comprising:

a piston-cylinder actuator;

said piston-cylinder actuator comprising a main cylinder defining a compression chamber, an annular piston mounted for reciprocal movement in said compression chamber, a hollow piston shaft for movement with said piston and having an upper end projecting from the upper end of said main cylinder, and a lower-tool mount affixed to said projecting upper end of said piston shaft for connection to a lower tool of a station of a packaging machine;

said annular piston defining an outer diameter and an inner diameter, the ratio of said outer diameter to said inner diameter being less than two; and mounting means for suspensively mounting said piston-cylinder actuator and therefore, a lower tool to a packaging machine in a suspended manner, said mounting means comprising a plurality of mounting rods, each said mounting rod having an upper end portion connected to a portion of a packaging machine and a lower end portion; said main cylinder of said piston-cylinder actuator comprising an upper plate; each said lower end portion of each said mounting rod being connected to a respective portion of said upper plate.

10. The improvement according to claim 9, wherein each said lower end portion of a respective said mounting rod is connected to a respective corner portion of said upper plate; said lower-tool mount comprising a mounting plate consisting of a main plate portion and rotation-prevention elements projecting from the ends of said main plate portion; said mounting rods passing in close proximity to said ends of said main plate portion; each said rotation-prevention element projecting into the space formed between a pair of mounting rods located at a respective end of said main plate portion for preventing rotation of said mounting plate and, therefore, a lower tool mounted thereto.

11. The improvement according to claim 9, wherein said lower-tool mount comprises a mounting plate consisting of a main plate portion and rotation-prevention elements projecting from the ends of said main plate portion cooperating with said mounting rods for preventing rotation of said mounting plate and, therefore, said lower tool mounted thereto.

12. The improvement according to claim 9, wherein said annular piston has an outer diameter in the range of between approximately 13⅛ in. and 13⅜ in. and an inner diameter in the range of between approximately 8½ in. and 8¾ in.

13. The improvement according to claim 9, wherein said piston rod has a diameter of between approximately 8½ in. and 8¾ in.

* * * * *